US012385331B2

(12) United States Patent
McCabe et al.

(10) Patent No.: US 12,385,331 B2
(45) Date of Patent: Aug. 12, 2025

(54) COILED TUBING TOOL FLOW TUBE ARCHITECTURE

(71) Applicant: Schlumberger Technology Corporation, Sugar Land, TX (US)

(72) Inventors: Jeffrey Conner McCabe, Houston, TX (US); Vong Vongphakdy, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/725,300

(22) PCT Filed: Mar. 3, 2023

(86) PCT No.: PCT/US2023/014449
§ 371 (c)(1),
(2) Date: Jun. 28, 2024

(87) PCT Pub. No.: WO2023/168042
PCT Pub. Date: Sep. 7, 2023

(65) Prior Publication Data

US 2025/0067131 A1 Feb. 27, 2025

Related U.S. Application Data

(60) Provisional application No. 63/268,809, filed on Mar. 3, 2022.

(51) Int. Cl.
*E21B 17/20* (2006.01)

(52) U.S. Cl.
CPC ..... *E21B 17/203* (2013.01)

(58) Field of Classification Search
CPC ..... E21B 17/20; E21B 17/203
See application file for complete search history.

(56) References Cited

U.S. PATENT DOCUMENTS

| | | | | |
|---|---|---|---|---|
| 11,506,027 | B1 * | 11/2022 | Sisk | E21B 41/0085 |
| 11,952,648 | B2 * | 4/2024 | Valdez | C21D 8/105 |
| 2001/0050172 | A1 * | 12/2001 | Tolman | E21B 43/27 166/305.1 |
| 2010/0084132 | A1 | 4/2010 | Noya | |
| 2010/0108313 | A1 * | 5/2010 | Chan | E21B 17/20 166/263 |
| 2011/0042090 | A1 | 2/2011 | Varkey | |

(Continued)

FOREIGN PATENT DOCUMENTS

WO 2007039836 A2 4/2007

OTHER PUBLICATIONS

Search Report and Written Opinion of International Patent Application No. PCT/US2023/014449 dated Jun. 20, 2023, 11 pages.

*Primary Examiner* — Shane Bomar
(74) *Attorney, Agent, or Firm* — Jeffrey D. Frantz

(57) ABSTRACT

An application tool may be coupled to a coiled tubing for performing an operation in a wellbore includes a rigid outer body and at least one flow tube. The rigid outer body includes a first material. The flow tube defines a flow path through the outer rigid body for receiving a corrosive fluid from the coiled tubing after the coiled tubing is coupled to the application tool. The flow tube includes a second material that is corrosion resistant and different than the first material.

20 Claims, 3 Drawing Sheets

(56) References Cited

U.S. PATENT DOCUMENTS

| | | | | |
|---|---|---|---|---|
| 2011/0272134 | A1* | 11/2011 | Roy | C21D 9/14<br>219/121.85 |
| 2014/0174749 | A1* | 6/2014 | Barber | E21B 17/041<br>166/242.6 |
| 2016/0074905 | A1 | 3/2016 | Eason | |
| 2016/0258231 | A1* | 9/2016 | Naumann | E21B 17/003 |
| 2018/0374607 | A1* | 12/2018 | Hernandez Marti | H01B 7/18 |
| 2021/0252663 | A1 | 8/2021 | Bayer | |

* cited by examiner

COILED TUBING TOOL FLOW TUBE ARCHITECTURE

CROSS-REFERENCE TO RELATED APPLICATION

This application is a National Stage Entry of International Patent Application No. PCT/US2023/014449, filed on Mar. 3, 2023, which claims benefit of U.S. Patent Application Ser. No. 63/268,809, filed on Mar. 3, 2022, which is incorporated herein by reference.

TECHNICAL FIELD

This patent application describes an improved architecture and components for a coiled tubing tool. In particular, the materials of the architecture and components of the coiled tubing tool minimize tool wear from corrosive fluids while also minimizing the expense of manufacturing the coil tubing tool.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statement are to be read in this light, and not as admissions of prior art.

Exploring, drilling, and completing hydrocarbon and other wells are generally complicated, time consuming, and, ultimately, very expensive endeavors. As such, tremendous emphasis is often placed on well access in the hydrocarbon recovery industry. That is, access to a well at an oilfield for monitoring its condition and maintaining its proper health is of great importance. As described below, such access to the well is often provided by way of coiled tubing or slickline as well as other forms of well access lines.

Coiled tubing may be configured to deliver interventional or monitoring tools downhole. In addition to providing a robust mode of interventional access, coiled tubing is a tubular conveyance. Thus, fluid may be accommodated through an interior thereof for a host of downhole applications. So, for example, a tool near the end of the coiled tubing may utilize hydraulic functionality from the coiled tubing, be utilized to deliver fluids from the coiled tubing, or otherwise take advantage of fluid capabilities. In the case of fluid delivery, the tool may be a water jet cutting tool, a chemical injection tool or other tool that is configured for directing harsh or corrosive fluids to targeted downhole locations.

SUMMARY

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, embodiments may encompass a variety of forms that may be similar to or different from the embodiments set forth below.

In one embodiment, an application tool may be coupled to a coiled tubing for performing an operation in a wellbore. The application tool includes a rigid outer body and at least one flow tube. The rigid outer body includes a first material. The flow tube defines a flow path through the outer rigid body for receiving a corrosive fluid from the coiled tubing after the coiled tubing is coupled to the application tool. The flow tube includes a second material that is corrosion resistant and different than the first material.

In another embodiment, an application tool may be coupled to a coiled tubing for performing an operation in a wellbore. The application tool includes an outer body and at least two flow tubes. The outer body includes a first material. The two flow tubes define respective flow paths through the outer body for receiving respective fluids from the coiled tubing after the coiled tubing is coupled to the application tool. The two flow tubes include respective second materials that are corrosion resistant and are different than the first material.

In another embodiment, an application tool may be coupled to a coiled tubing for performing an operation in a wellbore. The application tool includes an outer body, an outer flow tube disposed within the outer body, and at least two flow tubes. The outer body includes a first material. The two flow tubes define respective flow paths through the outer flow tube for receiving respective fluids from the coiled tubing after the coiled tubing is coupled to the application tool. The two flow tubes include respective second materials that are corrosion resistant and are different than the first material.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
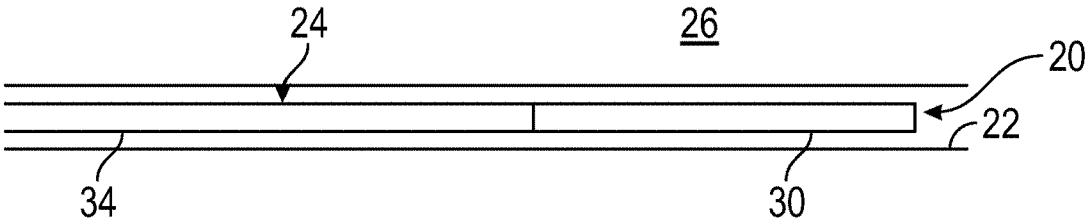
FIG. 1 is a schematic illustration of an exemplary well system conveyed downhole into a borehole, according to an embodiment of the disclosure.

One or more specific embodiments will be described below. In an effort to provide a concise description of these embodiments, all features of an actual implementation may not be described in the specification. It should be appreciated that in the development of any actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

As mentioned above, coiled tubing may be configured to deliver interventional or monitoring tools downhole. In addition to providing a robust mode of interventional access, coiled tubing is a tubular conveyance. Thus, fluid may be accommodated through an interior thereof for a host of downhole applications. So, for example, a tool near the end of the coiled tubing may utilize hydraulic functionality from the coiled tubing, be utilized to deliver fluids from the coiled tubing, or otherwise take advantage of fluid capabilities. In the case of fluid delivery, the tool may be a water jet cutting tool, a chemical injection tool, or other suitable tool that is configured for directing fluids to targeted downhole locations.

Unfortunately, where the coiled tubing application calls for the use of corrosive fluids, the deteriorating effects on the coiled tubing and the application tool may become quite costly. In most instances, the coiled tubing may be constructed of comparatively inexpensive, steel-based materials and may be considered consumable after a predetermined number of uses. However, application tools may be considerably more intricate, complex and expensive, at least on a per unit measure basis.

Due to the comparative importance of the coiled tubing tool and the overriding desire that it generally not be treated as a consumable, it is often constructed of more robust materials that are more resistant to corrosive fluids. For example, nickel-based superalloys are often utilized to construct coiled tubing tools.

Unfortunately, even where such robust material use is limited to the coiled tubing tool, expenses may become quite extreme. For example, the tool may be a smart tool of several feet in length. Thus, when constructed primarily of a superalloy, the expense may run in the tens of thousands of dollars. As a result, coiled tubing tools that are subject to corrosive fluid exposure are often constructed of materials of lesser expense and remain prone to deterioration well before a desired useful life of the tool.

The present disclosure outlines a novel and non-obvious architecture and components for a coiled tubing tool. The component materials and architecture of the tool allows for tool construction in a manner that minimizes tool wear from corrosive fluids while also minimizing tool expense due to material expense. More specifically, the tool may utilize unique flow tubes of specialized, corrosive resistant materials through an internal body. These tubes manage substantially all direct contact with corrosive fluids through the tool without requirement that the remainder of the tool architecture be constructed of such specialized corrosive resistant materials.

With the foregoing in mind, FIG. 1 is a schematic illustration of an exemplary well system 20 conveyed downhole into a borehole 22 (e.g., a wellbore) in accordance with certain embodiments of the present disclosure. The well system 20 is part of an overall well string 24 which is conveyed downhole into the borehole 22 to a desired position for operation. By way of example, borehole 22 may be in the form of a wellbore drilled into a formation 26 containing desirable hydrocarbons, such as oil and gas.

As illustrated, the well system 20 includes an application tool 30. The application tool 30 may include a well tool (e.g., a coiled tubing tool, device, coupling, or other implement) and/or work in cooperation with a well tool to enable performance of a desired operation downhole. By way of example, the application tool 30 is configured to be coupled with coiled tubing 34. The coiled tubing 34 may be used to convey the application tool 30 downhole to a desired location along borehole 22 for performance of a desired operation downhole.

Additionally, the coiled tubing 34 may be used to direct one or more fluids through the interior of the coiled tubing 34 to the application tool 30 for a desired operation. In particular, the body of the application tool 30 includes one or more flow paths defined by respective flow tubes for receiving the fluids from the coiled tubing 34 and directing the fluids through the body of the application tool 30 for the desired operation. The respective flow tubes within the body of the application tool 30 include specialized metal alloys that resist wear that may be caused to the application tool 30 by the fluids flowing therein. For instance, the fluids may cause corrode the application tool 30 and/or the flow tubes within the application tool 30. Additionally, the fluids may flow through the flow tubes under pressure, which may also cause wear to the flow tubes.

Figure 2:
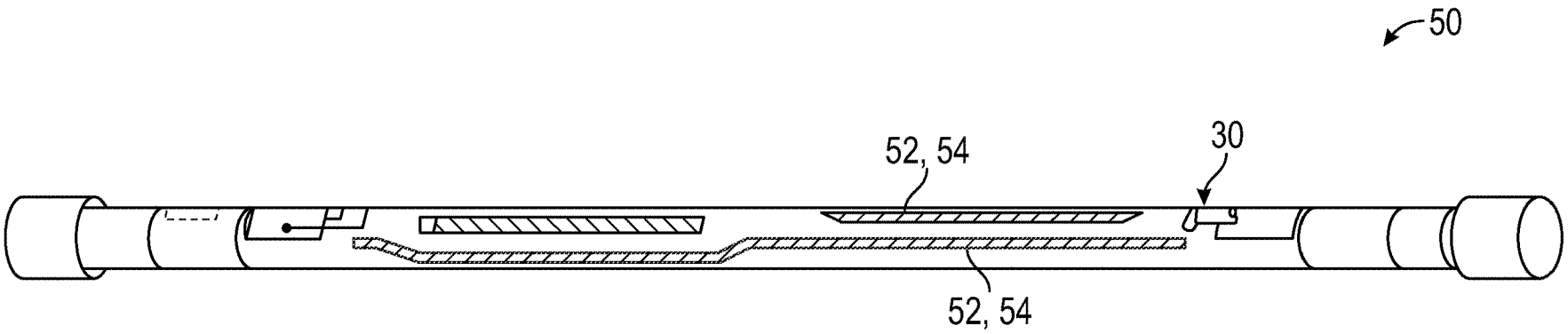
FIG. 2 is a perspective view of an exemplary application tool that is configured to be coupled to coiled tubing of the exemplary well system of FIG. 1, according to an embodiment of the disclosure.

With the foregoing in mind, FIG. 2 is a perspective view 50 of the application tool 30 of FIG. 1. The application tool 30 includes one or more flow tubes 52 that define respective flow paths 54 through the application tool 30. The flow tubes 52 of the application tool 30 may direct one or more fluids through the application tool 30 for use in a desired operation. The flow tubes 52 are made of specialized metal alloys that contain fluid under pressure and resist wear caused by the fluids, such as corrosion and the like. The use of corrosion resistant flow tubes 52 to direct fluids through the application tool 30 allows other components of the application tool 30 (e.g., body, other interior components) to be constructed of other less specialized materials. That is, the flow tubes 52 may be made of a first material and other components of the application tool 30 may be made of one or more second materials different from the first material. As a result, cost savings and/or unique packaging constraints may be utilized without compromising tool resistance to the corrosive fluids.

In certain embodiments, the flow tubes 52 include a specialized metal alloy (e.g., a specialized nickel alloy). While a specialized metal alloy is typically costlier, the narrow diameter and limited length of the flow tubes 52 within the application tool 30 minimizes the expense of manufacturing the application tool 30 while rendering the entire application tool 30 resistant to corrosives, such as acids, solvents, and other typical downhole application corrosives.

Figure 3:
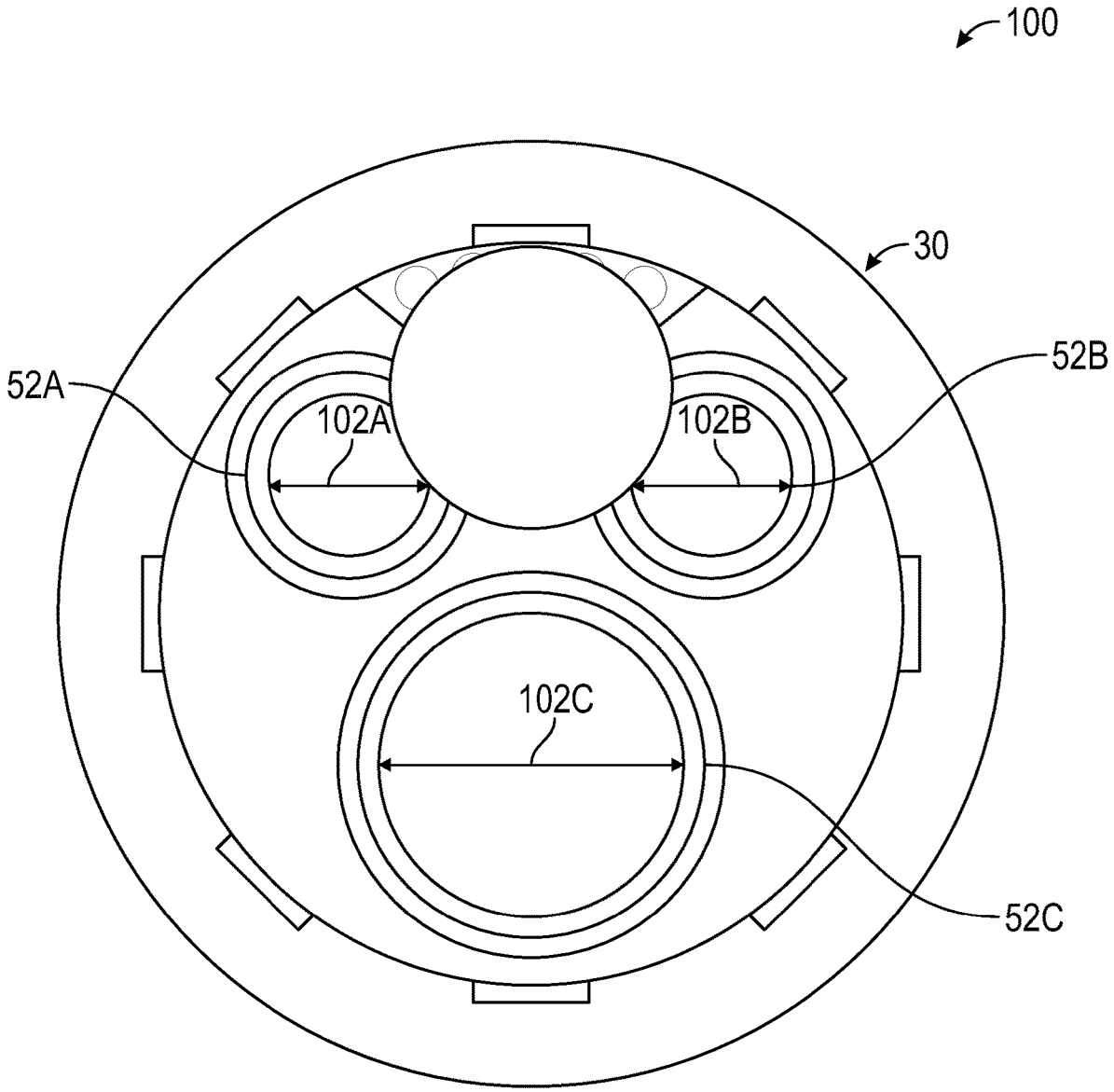
FIG. 3 is a cross-section view of an exemplary application tool, according to an embodiment of the disclosure.

FIG. 3 is a cross-sectional view 100 of the application tool 30 illustrated in FIG. 1, according to certain embodiments of the present disclosure. As illustrated in FIG. 3, the application tool 30 includes three flow tubes 52A, 52B, 52C. The first flow tube 52A has a first diameter 102A, the second flow tube 52B has a second diameter 102B, the third flow tube 52C has a third diameter 102C. In certain embodiments, the first diameter 102A, the second diameter 102B, and the third diameter 102C may be different. In other embodiments, two or more of the first diameter 102A, the second diameter 102B, and the third diameter 102C may be the same (or substantially the same).

In any case, the first flow tube 52A, the second flow tube 52B, and the third flow tube 52C may be constructed with a specialized material. In particular, the specialized material may be corrosion resistant, such as a specialized metal alloy (e.g., a specialized nickel alloy, a nickel super alloy, an austenitic nickel-chromium based superalloy, a nickel-copper alloy, a nickel-copper alloy with trace amounts of iron, manganese, carbon, and/or silicon, or the like). In one embodiment, the first flow tube 52A, the second flow tube 52B, and the third flow tube 52C may be particularly resistant to hydrogen sulfide.

In certain embodiments, the first flow tube 52A, the second flow tube 52B, and the third flow tube 52C may be constructed of the same material. In other embodiments, two or more of the first flow tube 52A, the second flow tube 52B, and the third flow tube 52C may be made of different materials. In any case, at least one of the first flow tube 52A, the second flow tube 52B, and the third flow tube 52C is constructed of a different material than other components of the application tool 30. For instance, the first flow tube 52A, the second flow tube 52B, and/or the third flow tube 52C may be directly adjacent or proximate to an additional component of the application tool 30 that is made of a different material than the first flow tube 52A, the second flow tube 52B, and/or the third flow tube 52C. In some embodiments, the different material may include a plastic, a non-specialized material, or the like.

Figure 4A:
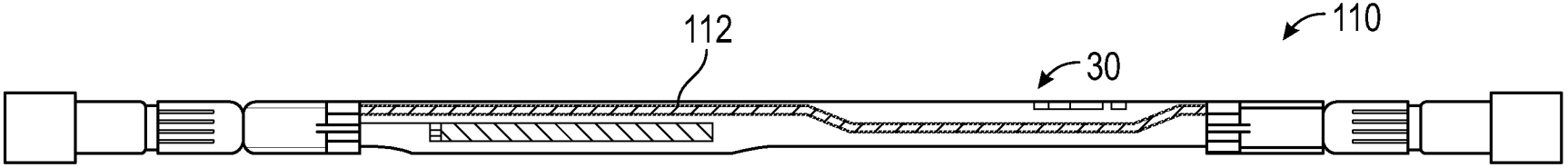
FIG. 4A is a top view of an exemplary application tool, according to an embodiment of the disclosure.
Figure 4B:
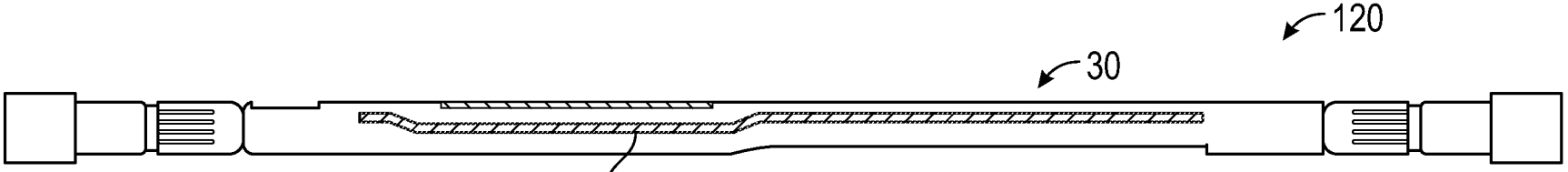
FIG. 4B is a front view of the exemplary application tool of FIG. 4A, according to an embodiment of the disclosure.
Figure 4C:
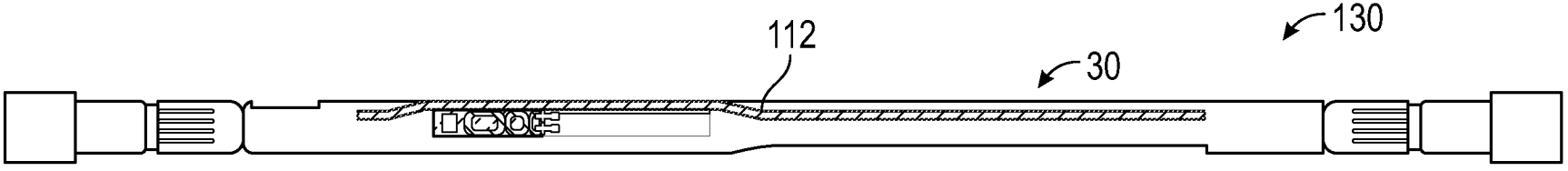
FIG. 4C is a back view of the exemplary application tool of FIG. 4A, according to an embodiment of the disclosure.
Figure 4D:
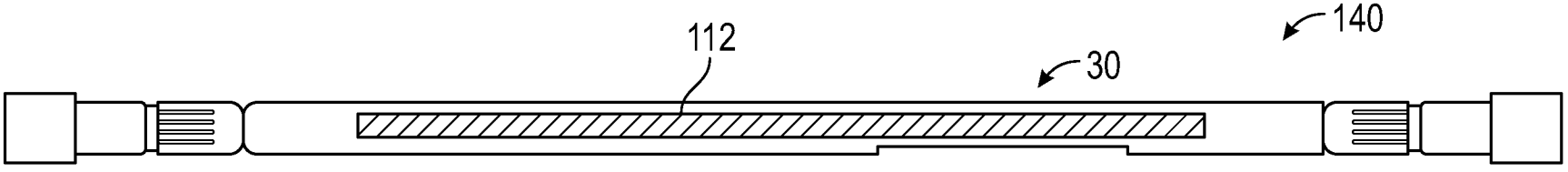
FIG. 4D is a bottom view of the exemplary application tool of FIG. 4A, according to an embodiment of the disclosure.

FIGS. 4A-4D are respective side sectional views of the application tool 30 in accordance with certain embodiments of the present disclosure. FIG. 4A is a top view 110 of the application tool 30, FIG. 4B is a front view 120 of the application tool 30, FIG. 4C is a back view 130 of the application tool 30, and FIG. 4D is a bottom view 140 of the application tool 30. As mentioned above, one or more flow tubes 112 of the application tool 30 may be constructed of specialized material, such as a nickel super alloy (e.g., an austenitic nickel-chromium based superalloy), a nickel-copper alloy with trace amounts of iron, manganese, carbon and/or silicon, or other suitable corrosion resistant nickel-based material.

Note that apart from the cost of outfitting the entire coiled tubing with such material architecture, limiting the flow tubes within the tool to such construction includes an added benefit. Specifically, while stress and wear throughout the entirety of a coiled tubing (e.g., 34) may render such components less durable over the course of coiled tubing applications, limiting the component architecture to the more minimal length of a tool body of the application tool 30, limits such stress on the components. Indeed, the tool body of the application tool 30 itself may serve as a more rigid safeguard to the internal flow tube architecture (e.g., the flow tube 112).

The flow tubes (e.g., 52, 112) detailed herein may be singular for one large flow path, or there may be multiple tubes to allow multiple flow paths in the same tool body. In certain embodiments, an outer flow tube (e.g., 52, 112) may include two or more flow tubes (e.g., 52A, 52B, 52C). In such embodiments, the outer flow tube may be constructed of the same material as the inner flow tubes or of a different material as the inner flow tubes. The use of flow tubes 52, 112 to covey the fluid allows the main internal tool chassis to be made out of lower cost materials for cost saving purposes. This separate tool body of the application tool 30 can also make use of novel manufacturing techniques such as 3D printing to allow for packaging of internal components such as, but not limited to, sensors, motors, electronic circuit boards, wiring harnesses, pumps, solenoids, and batteries. The use of these flow tubes 52, 112 also allows for their replacement if necessary due to erosion or other wearing. This replacability allows only the parts that wear out to be replaced. Therefore, the overall life of the asset (e.g., the application tool 30) can be greatly increased and the overall cost of ownership decreased. Additionally, the flow tubes (e.g., 52, 112) can be made of different materials to accommodate specific requirements. Stainless steel can be used to convey hydraulic fluid if required, while even more corrosion resistant nickel-based alloys can be used to convey treatment or well bore fluids.

In certain embodiments of the present disclosure, an application tool that may be coupled to a coiled tubing for performing an operation in a wellbore includes a rigid outer body and at least one flow tube. The rigid outer body includes a first material. The flow tube defines a flow path through the outer rigid body for receiving a corrosive fluid from the coiled tubing after the coiled tubing is coupled to the application tool. The flow tube includes a second material that is corrosion resistant and different than the first material.

In some embodiments, the second material includes a specialized metal alloy. In some embodiments, the specialized metal alloy includes a specialized nickel alloy. In some embodiments, the specialized nickel alloy is an austenitic nickel-chromium based superalloy. In some embodiments, the specialized metal alloy includes a nickel-copper alloy. In some embodiments, the nickel-copper alloy includes a trace amount of iron, manganese, carbon, or silicon, or a combination thereof. In some embodiments, the flow tube includes two or more inner flow tubes that include the second material.

In certain embodiments of the present disclosure, an application tool may be coupled to a coiled tubing for performing an operation in a wellbore. The application tool includes an outer body and at least two flow tubes. The outer body includes a first material. The two flow tubes define respective flow paths through the outer body for receiving respective fluids from the coiled tubing after the coiled tubing is coupled to the application tool. The two flow tubes include respective second materials that are corrosion resistant and are different than the first material.

In some embodiments, the respective second materials include a specialized nickel alloy. In some embodiments, the specialized nickel alloy is an austenitic nickel-chromium based superalloy. In some embodiments, the respective second materials include a nickel-copper alloy. In some embodiments, a first diameter of a first flow tube of the two flow tubes is different than a second diameter of a second flow tube of the two flow tubes. In some embodiments, the respective second material are resistant to hydrogen sulfide. In some embodiments, the application tool includes an outer flow tube that includes the two flow tubes.

In certain embodiments of the present disclosure, an application tool may be coupled to a coiled tubing for performing an operation in a wellbore. The application tool includes an outer body, an outer flow tube disposed within the outer body, and at least two flow tubes. The outer body includes a first material. The two flow tubes define respective flow paths through the outer flow tube for receiving respective fluids from the coiled tubing after the coiled tubing is coupled to the application tool. The two flow tubes include respective second materials that are corrosion resistant and are different than the first material.

In some embodiments, the respective second materials include a specialized nickel alloy. In some embodiments, the specialized nickel alloy is an austenitic nickel-chromium based superalloy. In some embodiments, the respective second materials include a nickel-copper alloy. In some embodiments, the outer flow tube includes the first material. In some embodiments, the outer flow tube includes a third material different than the first material and the respective second materials.

While the foregoing is directed to embodiments of the present invention, other and further embodiments of the present disclosure may be devised without departing from the basic scope thereof, and the scope thereof is determined by the claims that follow. Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. An application tool configured to be coupled to a coiled tubing for performing an operation in a wellbore, comprising:

a rigid outer body comprising a body material; and three internal flow tubes defining respective flow paths through the rigid outer body for receiving respective different fluids from the coiled tubing after the coiled tubing is coupled to the application tool, wherein the three internal flow tubes comprise different materials relative to one another, at least one of the different materials is a corrosion resistant material, and at least one of the different fluids is a corrosive fluid.

2. The application tool of claim 1, wherein one or more of the different materials comprises a specialized metal alloy.

3. The application tool of claim 2, wherein the specialized metal alloy comprises a specialized nickel alloy.

4. The application tool of claim 3, wherein the specialized nickel alloy is an austenitic nickel-chromium based superalloy, a nickel-copper alloy, or both.

5. An application tool configured to be coupled to a coiled tubing for performing an operation in a wellbore, comprising:

an outer body comprising a body material; and three internal flow tubes defining respective flow paths through the outer body for receiving respective different fluids from the coiled tubing after the coiled tubing is coupled to the application tool, wherein the three internal flow tubes comprise different materials relative to one another and different than the body material, and at least one of the different materials is a corrosion resistant material.

6. The application tool of claim 5, wherein the corrosion resistant material comprises a specialized nickel alloy.

7. The application tool of claim 6, wherein the specialized nickel alloy is an austenitic nickel-chromium based superalloy, a nickel-copper alloy, or both.

8. The application tool of claim 5, wherein the different materials of the three internal flow tubes comprise at least one plastic.

9. The application tool of claim 5, wherein each of the three internal flow tubes has a different diameter than the other internal flow tubes.

10. The application tool of claim 5, wherein the corrosion resistant material is resistant to hydrogen sulfide.

11. The application tool of claim 5, wherein the outer body is an outermost body of the application tool, only the three internal flow tubes are disposed inside of the outer body, the three internal flow tubes are spaced apart from one another inside of the outer body, and an interior cavity of the outer body extends directly from an interior surface of the outer body to exterior surfaces of the three internal flow tubes.

12. An application tool configured to be coupled to a coiled tubing for performing an operation in a wellbore, comprising:

an outer body comprising a body material;

an outer flow tube disposed within the outer body; and three internal flow tubes defining respective flow paths through the outer flow tube for receiving respective different fluids from the coiled tubing after the coiled tubing is coupled to the application tool, wherein the three internal flow tubes comprise different materials relative to one another and different than the body material.

13. The application tool of claim 12, wherein each of the different materials is corrosion resistant and comprises a specialized nickel alloy.

14. The application tool of claim 13, wherein the specialized nickel alloy is an austenitic nickel-chromium based superalloy, a nickel-copper alloy, or both.

15. The application tool of claim 12, wherein the three internal flow tubes are independently removable and replaceable relative to the outer body, and the outer body is an outermost body of the application tool.

16. The application tool of claim 15, wherein only the three internal flow tubes are disposed inside of the outer flow tube, and the three internal flow tubes are spaced apart from one another inside of the outer flow tube.

17. The application tool of claim 1, wherein the three internal flow tubes are configured to couple to a water jet cutting tool, a chemical injection tool, and a tool targeting fluid to a downhole location.

18. The application tool of claim 1, wherein the three internal flow tubes are independently removable and replaceable relative to the rigid outer body, the rigid outer body is an outermost body of the application tool, and only the three internal flow tubes are disposed inside of the rigid outer body.

19. The application tool of claim 5, wherein the three internal flow tubes are configured to couple to a water jet cutting tool, a chemical injection tool, and a tool targeting fluid to a downhole location.

20. The application tool of claim 5, wherein the three internal flow tubes are independently removable and replaceable relative to the outer body.

* * * * *